US010961734B2

(12) United States Patent
Benton et al.

(10) Patent No.: US 10,961,734 B2
(45) Date of Patent: Mar. 30, 2021

(54) NON-WELD JOIST REINFORCEMENT SYSTEM AND METHOD

(71) Applicants: Jason Rickman Benton, Tallassee, AL (US); Allen Gunn, Tallassee, AL (US)

(72) Inventors: Jason Rickman Benton, Tallassee, AL (US); Allen Gunn, Tallassee, AL (US)

( * ) Notice: Subject to any disclaimer, the term of this patent is extended or adjusted under 35 U.S.C. 154(b) by 0 days.

(21) Appl. No.: 16/208,088

(22) Filed: Dec. 3, 2018

(65) Prior Publication Data

US 2019/0169845 A1 Jun. 6, 2019

Related U.S. Application Data

(60) Provisional application No. 62/593,588, filed on Dec. 1, 2017.

(51) Int. Cl.

| | |
|---|---|
| ***E04H 12/00*** | (2006.01) |
| ***E04G 23/02*** | (2006.01) |
| ***E04C 3/04*** | (2006.01) |
| ***E04C 3/08*** | (2006.01) |
| *E04C 3/02* | (2006.01) |

(52) U.S. Cl.

CPC ..... *E04G 23/0218* (2013.01); *E04C 3/04* (2013.01); *E04C 3/08* (2013.01); *E04C 2003/026* (2013.01); *E04C 2003/0408* (2013.01); *E04C 2003/0417* (2013.01); *E04C 2003/0434* (2013.01); *E04C 2003/0447* (2013.01);

(Continued)

(58) Field of Classification Search

CPC ..... E04G 23/0218; E04C 3/04; E04C 3/00; E04C 3/02; E04C 3/08; E04C 2003/026; E04C 2003/0408; E04C 2003/0491; E04C 2003/2003; E04C 2003/0417; E04C 2003/0434; E04C 2003/0452; E04C 2003/0447; E04C 2003/0404

USPC ..... 52/223.11, 223.8, DIG. 11, 127.2, 126.7, 52/645, 697, 693, 223.1; 248/220.1, 248/354.3

See application file for complete search history.

(56) References Cited

U.S. PATENT DOCUMENTS 2,939,206 A 6/1960 Keller
4,304,078 A * 12/1981 Meriwether, Jr. ... E04F 21/0015 248/354.3

(Continued)

FOREIGN PATENT DOCUMENTS

KR 10-0175739 5/1999
WO 2017055837 A1 4/2017

OTHER PUBLICATIONS

Mar. 19, 2019 PCT/US2018/063579 International Search Report and Written Opinion, 13 pages.

*Primary Examiner* — Chi Q Nguyen
(74) *Attorney, Agent, or Firm* — Waller Lansden Dortch & Davis, LLP; Blake M. Bernard

(57) ABSTRACT

A joist chord reinforcement apparatus for a joist having a chord with a first chord end and a second chord end is disclosed that includes a reinforcement rod, first and second end clamp assemblies operable to clamp the reinforcement rod to the first and second ends of the chord respectively, and at least one rod clamping assembly operable to secure the reinforcement rod to the chord between the first and second end clamp assemblies when the first and second end clamp assemblies are clamping the reinforcement rod to first and second ends of the chord respectively. A method of reinforcing the chord of a joist is also disclosed.

18 Claims, 13 Drawing Sheets

(52) U.S. Cl.
CPC ..... *E04C 2003/0452* (2013.01); *E04C 2003/0491* (2013.01)

(56) References Cited

U.S. PATENT DOCUMENTS

| | | | | | |
|---|---|---|---|---|---|
| 5,359,821 | A * | 11/1994 | Merriman | E02D 27/34 | 52/126.6 |
| 6,230,448 | B1 * | 5/2001 | Oliver | E04G 23/0218 | 248/200.1 |
| 6,243,996 | B1 * | 6/2001 | Oliver | E04G 23/0218 | 248/200.1 |
| 6,354,056 | B1 | 3/2002 | Korzen | | |
| 6,571,527 | B1 | 6/2003 | Rattini | | |
| 7,360,341 | B2 * | 4/2008 | Jackson | E04G 11/50 | 52/645 |
| 7,748,180 | B1 * | 7/2010 | Plavidal | E04B 5/12 | 52/223.8 |
| 9,587,401 | B1 * | 3/2017 | Benton | E04C 3/02 | |
| 2003/0131543 | A1 * | 7/2003 | Hansort | E04G 21/26 | 52/127.2 |

* cited by examiner

NON-WELD JOIST REINFORCEMENT SYSTEM AND METHOD

CROSS-REFERENCES TO RELATED APPLICATIONS

This application is a non-provisional of U.S. Patent Application No. 62/593,588 filed Dec. 1, 2017 entitled NON-WELD JOIST CHORD REINFORCEMENT SYSTEM, which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to structural reinforcement systems for joists.

More particularly, the present disclosure relates to reinforcement mechanisms for metal joists. Open web steel joists are commonly used framing systems for roofs and floors in many buildings. The joists typically include top and bottom chords, each chord including double L-shaped chord angles spaced in a back to back orientation. A plurality of cross support members extend between and can be connected or welded to the top and bottom chord members. Some of the cross supports can be vertically or perpendicularly oriented with respect to the top and bottom chords, and some of the cross supports can be oriented at an angle or diagonally oriented with respect to the top and bottom chords. The cross supports can form panel points along the top and bottom chords where adjacent diagonal and cross support members converge.

Loads originally present on the joist can be designed for and be concentrated or localized on the top and/or bottom chords of the joist near a panel point, such that reinforcement of the top and bottom chords by the cross support members converging at the panel point can help support and distribute the load via the cross support members about the top and bottom chords of the joist. However, often times after a building is constructed, the building can be modified with new, additional, or replacement features which can increase the load profile on an existing joist in the building. One such situation is when a heating, ventilation, and air conditioning (HVAC) unit supported by a joist directly, or by a roofing structure that is supported by the joist, wears out over time and needs to be replaced. In many cases a new HVAC unit can be substantially heavier than the prior unit, which can affect the total and/or localized load requirements on one or more joists in the building. Other loads that can be added to or replaced on an existing joist can include, but are not limited to, lighting systems, plumbing systems, sprinkler systems, flooring systems, roof structures, solar panels, mechanical equipment, structural additions to the building, furniture, etc. Additionally, it is often desirable to place a new or additional load on an existing joist at a location on the top or bottom chord of the joist that is offset from a panel point. In many instances, a local reinforcement on a top or bottom chord, or a reinforcement of an entire top or bottom chord is necessary.

Conventional solutions for reinforcing metal joists include welding one or more supports or braces to the top or bottom chords. To reinforce the entire top or bottom chord, a reinforcement rod is welded along substantially the entire length of the chord. To locally reinforce a top or bottom chord at a single point along the top or bottom chord corresponding to the new load, a support or brace can be welded at one end to the top or bottom chord near the location of the new load, and the other end of the support or brace can be welded to a nearby panel point to locally reinforce the top or bottom chord of the joist and transfer the new load to the panel point.

However, welding these supports into place can overheat and weaken the structural integrity of the joists. Supports have to be properly fitted to the joists and this may involve several trips between the equipment being used to create the support and the joists. Specialized tools, e.g. welding equipment and masks, and certified welders have to be used to perform the welding. Welding is also a significant fire hazard inside of a building. Because of the risk of fire created by sparks, fire protection measures, e.g., weld blankets and additional safety staff, have to be employed during the welding process. Finally, welds have to be inspected after the welding process to ensure that supports have been properly welded to the joists. All of the above steps make welding reinforcement supports and braces burdensome and time consuming, which is undesirable.

U.S. Pat. No. 9,587,401 directed to a "bar joist reinforcement apparatus," which is hereby incorporated by reference in its entirety, discloses a non-welded support device for single point or localized concentrated load reinforcement. However, the device in U.S. Pat. No. 9,587,401 was suitable for supporting loads that were vertically aligned with a panel point, and not loads that were offset from a panel point.

What is needed then are improvements to reinforcement systems for metal joists.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is a joist reinforcement apparatus for a joist having a top chord, a bottom chord, and plurality of cross supports extending between the top chord and the bottom chord, the plurality of cross supports forming panel points along the joist. The apparatus can include a panel point bracket assembly securable about one of the panel points of the joist. A load bracket assembly can be securable to either the top chord or the bottom chord of the joist opposite the panel point. An adjustable coupling assembly can have a first end pivotally connected to the panel point bracket assembly and a second end pivotally connected to the load bracket assembly. Having an adjustable coupling assembly pivotally connected to both a panel point bracket assembly and a load bracket assembly can allow the reinforcement apparatus to be secured to the panel point for strength and extend at an angle to a vertical axis from the panel point to support a load that is off centered from the panel point.

Another aspect of the present disclosure is a joist chord reinforcement apparatus for a joist having a chord with a first chord end and a second chord end, the apparatus including a first chord end bracket and a second chord end bracket. A first reinforcement rod can be securable between the first and second chord end brackets to clamp the first and second chord end brackets against corresponding first and second chord ends of the joist. At least one rod clamping assembly can be operable to clamp the first reinforcement rod to the chord at a location between the first and second chord end brackets when the first reinforcement rod is secured between the first and second chord end brackets and the first and second chord end brackets are clamped against corresponding first and second chord ends of the joist.

Metal joist chord reinforcement systems for reinforcement of a single point load along a chord, reinforcement of the chord along the entire chord length, or a combined reinforcement system including reinforcement along the entire length of the chord as well as single point load reinforcement are provided herein. Each of these systems can be utilized without having to weld any components to the joist chords to help avoid the difficulties associated with traditional welding reinforcement techniques.

Numerous other objects, advantages and features of the present disclosure will be readily apparent to those of skill in the art upon a review of the following drawings and description of a preferred embodiment.

DETAILED DESCRIPTION

Figure 1:
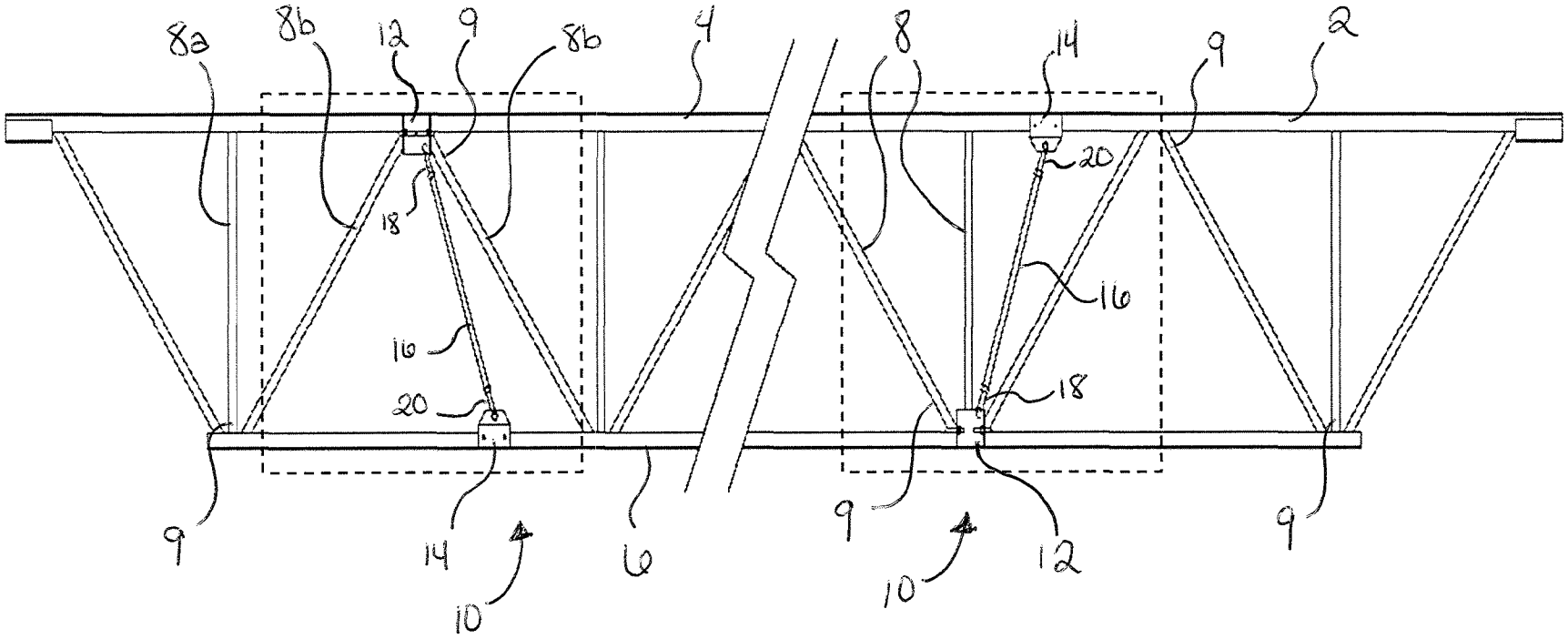
FIG. 1 is a front elevation view of a joist chord reinforced by multiple single point load joist reinforcement apparatuses.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

A joist reinforcement apparatus 10 is disclosed in FIG. 1 for reinforcing a joist 2 having a top chord 4, a bottom chord 6, and plurality of cross supports 8 extending between the top chord 4 and the bottom chord 6. The plurality of cross supports 8 can form panel points 9 along the joist 2 where two or more cross supports 8 converge with one another. Some panel points 9 can be formed with a vertical cross support member 8*a* and one or more angled cross support members 8*b*, wherein other panel points 9 can be formed with only angled cross support members 8*b*. Panel points 9 provide strength to the top or bottom chord 4 and 6 to which it is formed, as the chord 4 or 6 at the panel point 9 is supported by two or more cross support members 8. When a load is added to a joist, it is often beneficial to support the load by adding an additional cross support member 8 to the joist. The additional cross support member 8 can be connected at one end to the top or bottom chord adjacent the load, and at the other end to a nearby panel point 9 to distribute the load to the panel point 9 and help provide stability for the joist 2. In some circumstances, when the additional load causes the total load on the joist to exceed acceptable limits, it may become necessary to reinforce the chord along its entire length, in lieu of or in addition to single point reinforcement.

One aspect of the present disclosure is a joist reinforcement apparatus 10 shown in FIG. 1 for single point-reinforcement of the joist. The reinforcement apparatus 10 can include a panel point bracket assembly 12 securable about one of the panel points 9 of the joist 2, and a load bracket assembly 14 securable to either the top chord 2 or the bottom chord 4 of the joist 2 as appropriate. An adjustable coupling assembly 16 can have a first end 18 pivotally connected to the panel point bracket assembly 12 and a second end 20 pivotally connected to the load bracket assembly 14. The adjustable coupling assembly 16 can be adjusted to vary the length of the adjustable coupling assembly 16 such that when the panel point bracket assembly 12 is secured to the panel point 9, the load bracket assembly 14 can be secured to a top or bottom chord 4 or 6 of the joist 2 at a location adjacent the load.

Figure 3:
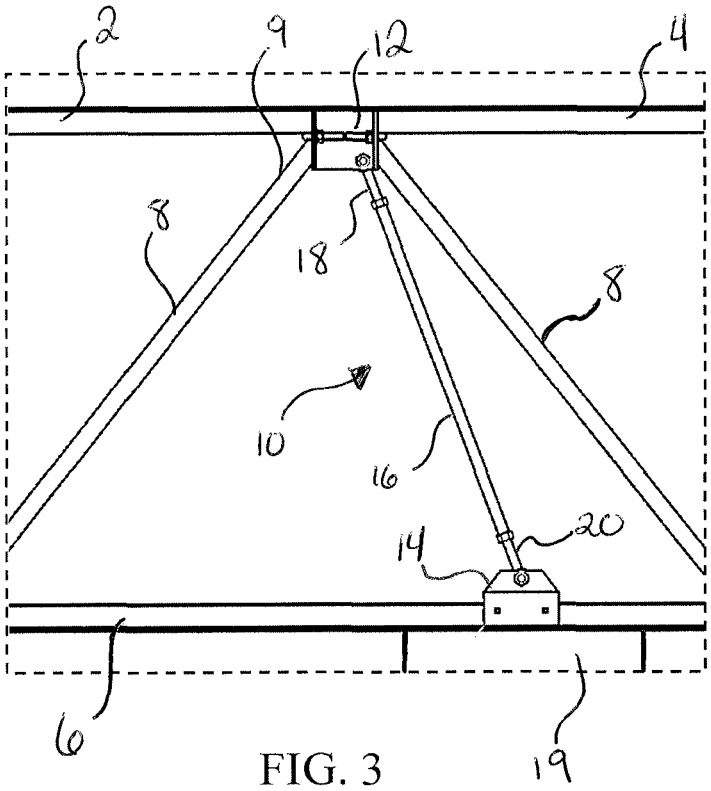
FIG. 3 is a detailed front elevation view of a first single point load joist reinforcement apparatus of FIG. 1 for a load suspended from a bottom chord of the joist.
Figure 7:
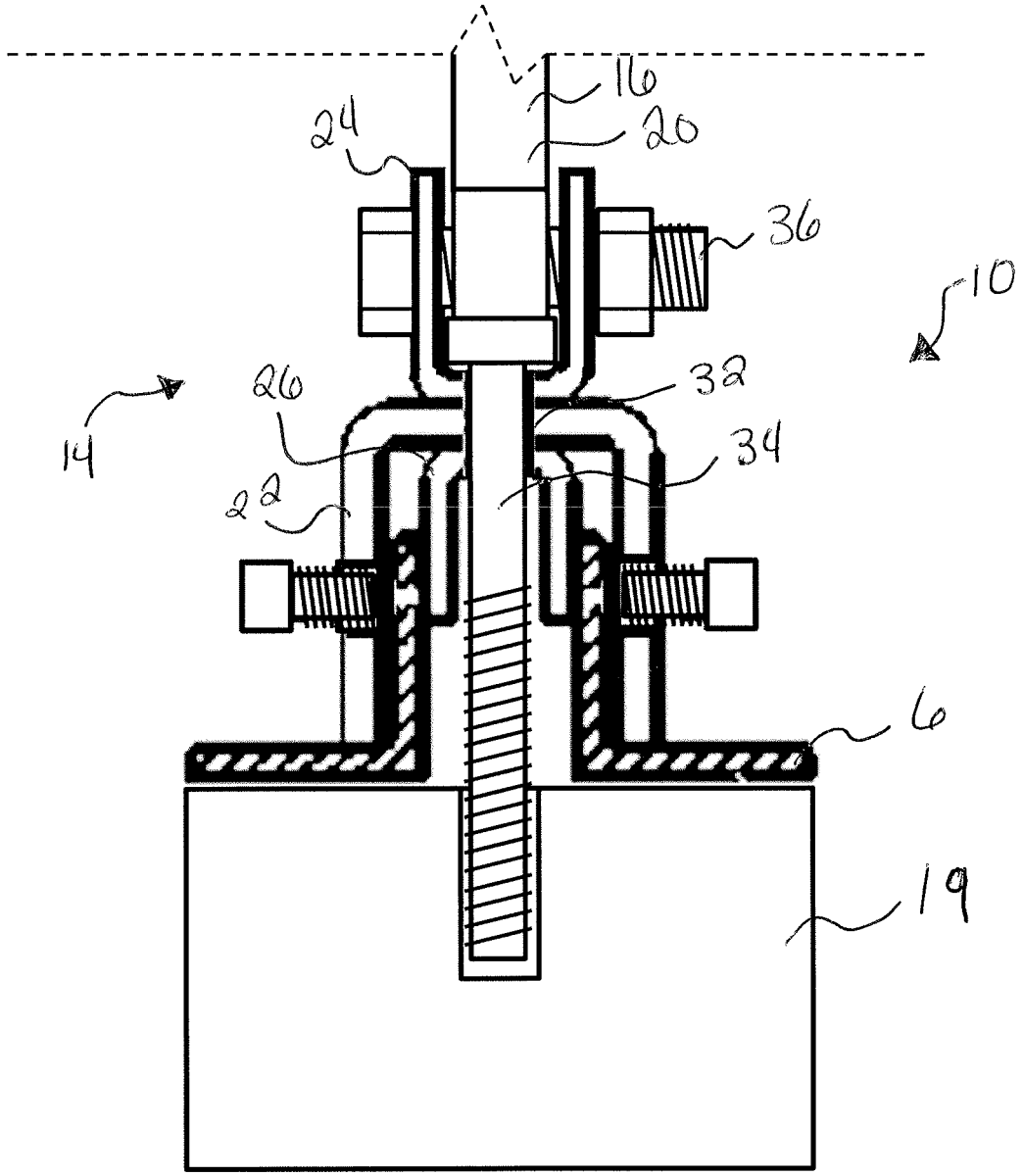
FIG. 7 is a detailed cross section view of a load bracket assembly of the single point load joist reinforcement apparatus of FIG. 3.

Having the adjustable coupling assembly 16 being pivotally connected to both the panel point bracket assembly 12 and the load bracket assembly 14 can allow the reinforcement apparatus 10 to be utilized as a cross support member to reinforce a load 19 along a chord 4 or 6 at a position that is offset vertically from the panel point 9, as shown in FIGS. 3 and 7. Prior art non-welding reinforcement apparatuses only allowed for reinforcement of loads vertically aligned with the panel point as they could not be angularly adjusted via a pivotal connection between a connection member and a panel point bracket and a load bracket.

Figure 2:
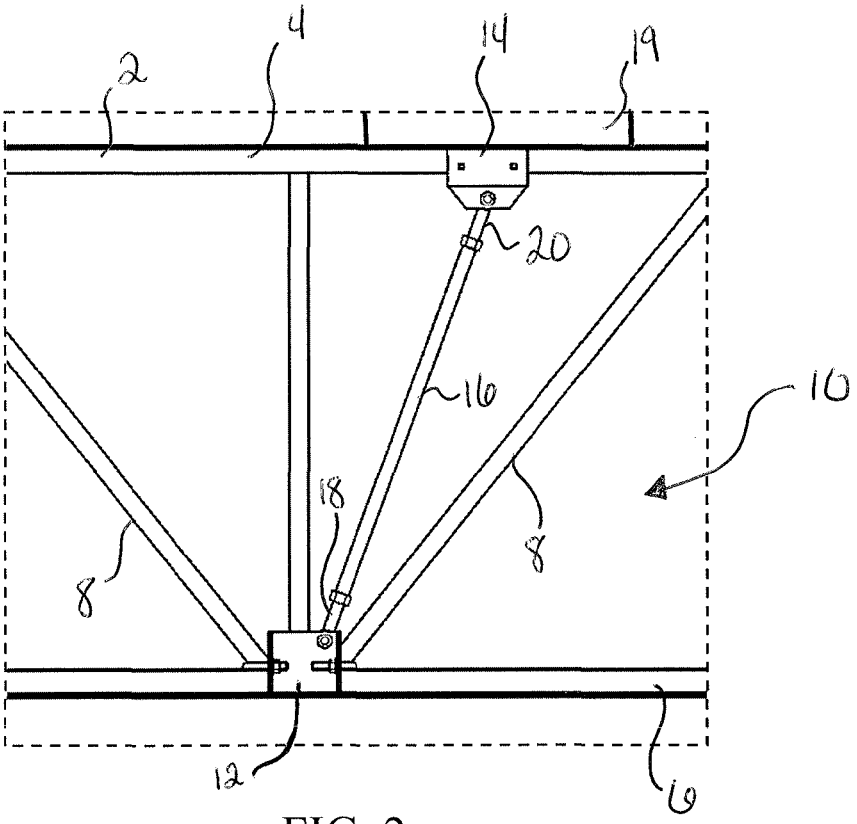
FIG. 2 is a detailed front elevation view of a first single point load joint reinforcement apparatus of FIG. 1 for a load positioned on a top chord of the joist.

As can be seen in FIGS. 2-3, the reinforcement apparatus 10 shown in FIG. 1 can be used to support a load 19 either positioned or resting on the top chord 4, or suspended from the bottom chord 6. When the load is positioned on the top chord 4, the panel point bracket assembly 12 can be secured to a nearby panel point 9 converging on the bottom chord 6 and the load bracket assembly 14 can be secured to the top chord 4 generally beneath the load 19, as shown in FIG. 2. When the load is suspended from the bottom chord 6, the panel point bracket assembly 12 can be secured to a nearby panel point 9 converging on the top chord 4 and the load bracket assembly 14 can be secured to the bottom chord 6 generally above the load 19, as shown in FIG. 3.

Figure 4:
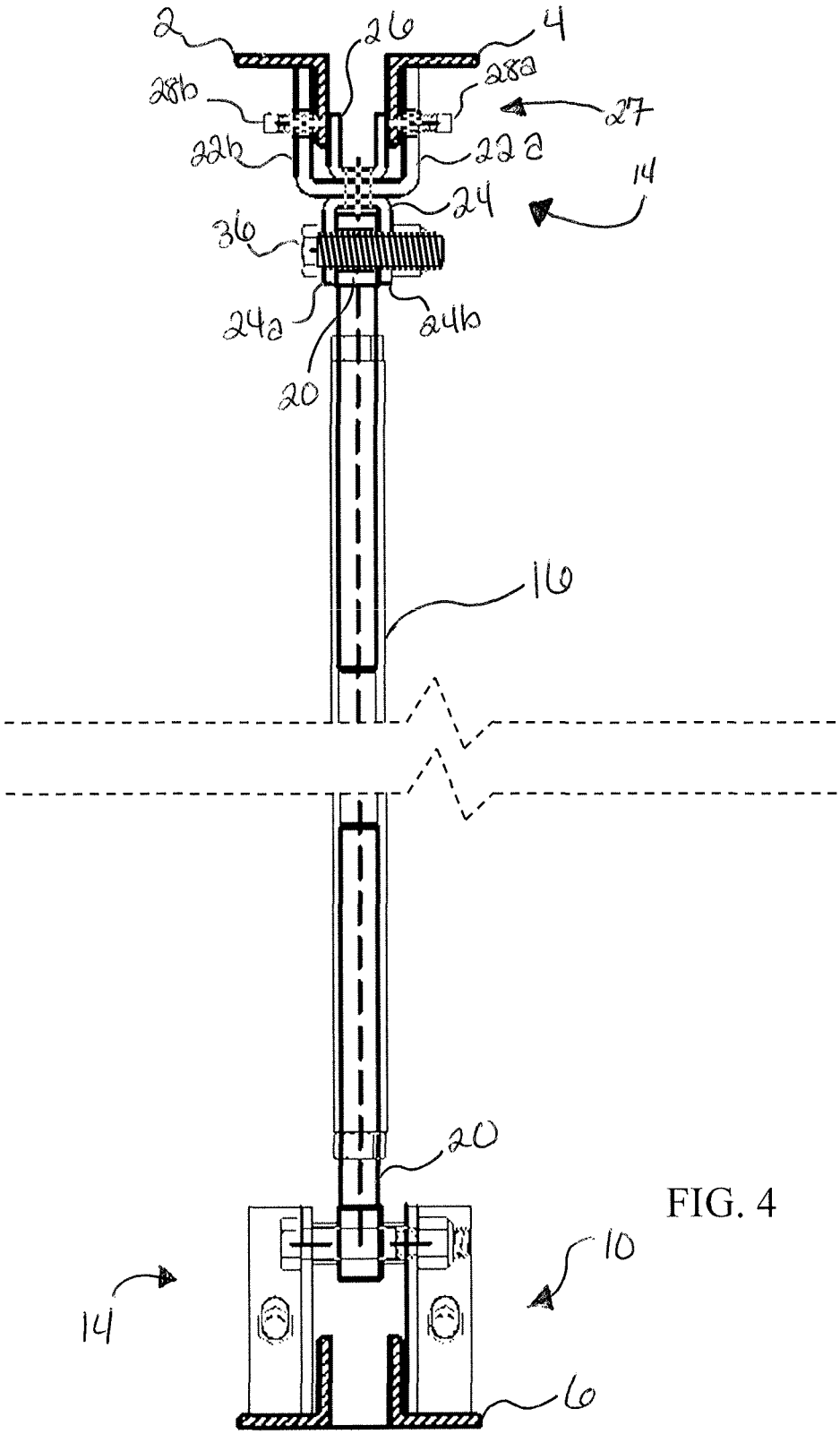
FIG. 4 is a cross sectional view of the single point load joist reinforcement apparatus of FIG. 2.
Figure 6:
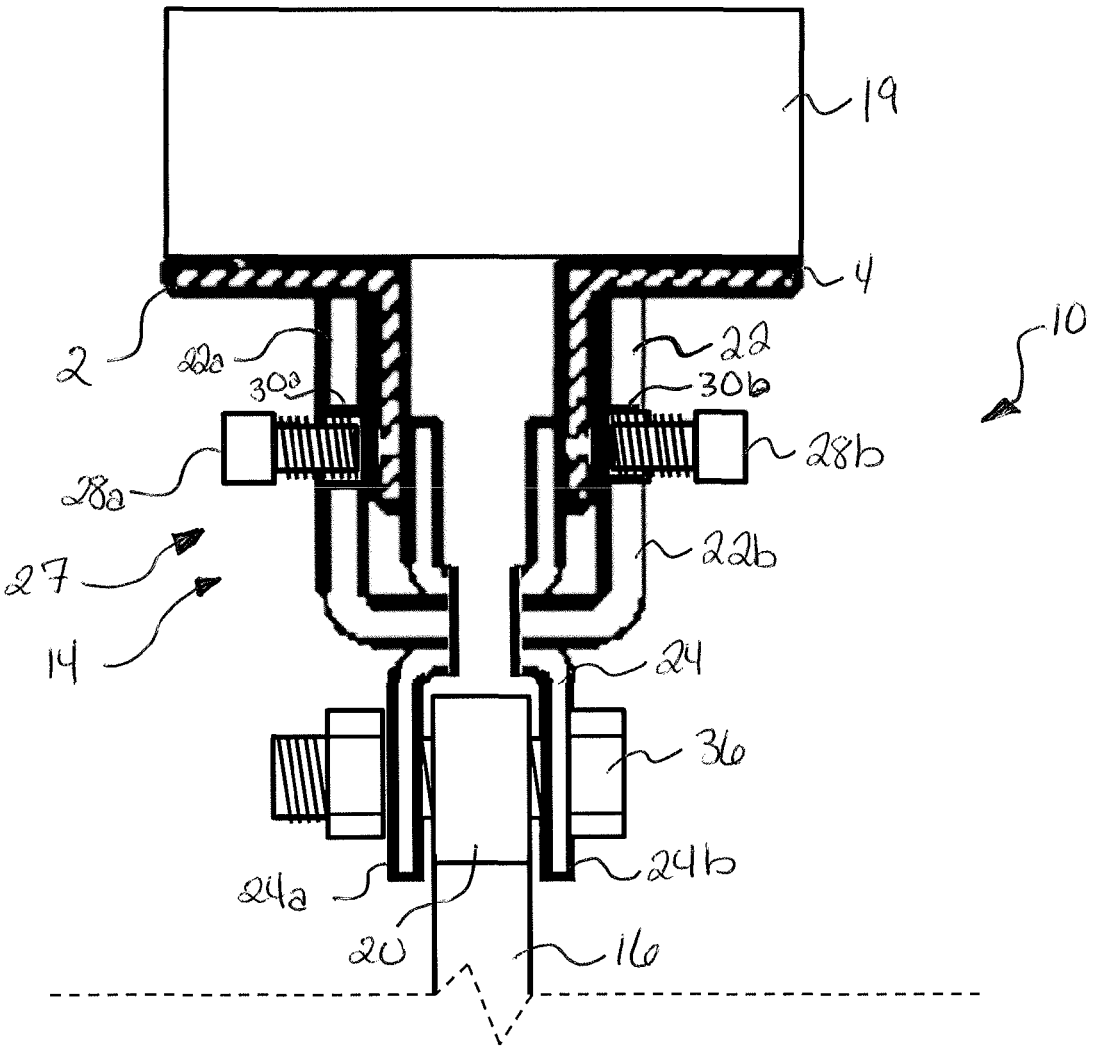
FIG. 6 is a detailed cross section view of a load bracket assembly of the single point load joist reinforcement apparatus of FIG. 2.

As shown in FIGS. 4, 6, and 7, the load bracket assembly 14 can include a chord portion 22 and a coupling portion 24. The chord portion 22 can be securable to either the top chord 4 or the bottom chord 6 of the joist 2. In some embodiments, the chord portion 22 can be shaped to receive the top or bottom chord 4 or 6 such that the chord portion 22 can be securable to either the top or bottom chords 4 or 6. The second end 20 of the adjustable coupling assembly 16 can be pivotally connected to the coupling portion 24. In some embodiments, the coupling portion 24 can be shaped to receive the second end 20 of the adjustable coupling assembly 16.

In some embodiments, the chord portion 22 can be a generally U-shaped or C-shaped chord flange and the coupling portion 24 can also be a generally U-shaped or C-shaped coupling flange. The chord flange 22 and coupling flange 24 can extend in opposite directions from one another. The U-shaped chord flange 22 can include chord flange extensions 22*a* and 22*b* which can extend on either side of the top or bottom chords 4 and 6 such that the top or bottom chords 4 or 6 can be secured between the chord flange extensions 22*a* and 22*b*. The U-shaped coupling flange 24 can include flange extensions 24*a* and 24*b* which can similarly be configured to receive and extend on either side of the second end 20 of the adjustable coupling assembly 16 such that the second end 20 of the adjustable coupling assembly 16 can be pivotally connected between the coupling flange extensions 24*a* and 24*b*.

In other embodiments, the chord flange 22 and the coupling flange 24 can include single plates or flanges that can extend on one side of the top or bottom chords 4 or 6 and the second end 20 of the adjustable coupling assembly 16, respectively. Having a double flange arrangement for both the chord portion 22 and the coupling portion 24 can help provide stability for the connections between the chord portion 22 and the top or bottom chords 4 or 6 and between the coupling portion 24 and the second end 20 of the adjustable coupling assembly 16. In some embodiments, the chord portion 22 and the coupling portion 24 can be integrally formed together as a single unit, while in other embodiments the chord portion 22 and the coupling portion 24 can be mechanically connected together via suitable fasteners, including but not limited to, bolts, screws, adhesives, etc.

In some embodiments, the load bracket assembly 14 can be secured to the top or bottom chords 4 or 6 such that the load bracket assembly 14 is not permanently fixed to the top or bottom chords 4 or 6. The load bracket assembly 14 can include a clamping element 27 operable to secure the load bracket assembly 14 to either the top chord 4 or the bottom chord 6 of the joist 2. In some embodiments, the clamping element 27 can include one or more set screws 28 that can extend through at least one flange extension 22*a* or 22*b* in the chord portion 22 and abut the top or bottom chord 4 or 6 positioned within the chord flange extensions 22*a* and 22*b* to effectively clamp the top or bottom chord 4 or 6 between the flange extensions 22*a* and 22*b*. In some embodiments, corresponding set screws 28 can extend through both the first and second chord flange extensions 22*a* and 22*b* to clamp the chord 4 or 6 between the first and second chord flange extensions 22*a* and 22*b* from both sides of the chord 4 or 6.

In some embodiments, at least one first set screw 28*a* can extend through the first chord flange extension 22*a* toward the second chord flange extension 22*b*, and at least one second set screw 28*b* can extend through the second chord flange extension 22*b* toward the first chord flange extension 22*a*. In still other embodiments, multiple set screws 28 can be inserted through each chord flange extension and extend toward the opposite flange to provide multiple points of clamping force along the chord 4 or 6 between the coupling portion 22 and the chord 4 or 6. The chord flange extensions 22*a* and 22*b* can include threaded bores 30, which can receive a corresponding set screw. When the chord 4 or 6 is positioned within the coupling portion 22, the set screws can be tightened within the threaded bores 30 to force the set crews toward the chord 4 or 6 and increase the clamping force applied to the chord 4 or 6 to secure the load bracket assembly 14 to the chord 4 or 6. The frictional force produced by the clamping of the set screws 28 against the chord 4 or 6 can help prevent sliding of the load bracket assembly 14 on the chord 4 or 6 during use.

In other embodiments, various types of clamping elements can be utilized to clamp the load bracket assembly 14 to the chord 4 or 6, including but not limited to vice clamps of other eccentric cam-type clamping mechanisms that can be selectively actuated to force a cam or grip member against the chord 4 or 6 to clamp the load bracket assembly 14 to the chord 4 or 6.

In some embodiments, as shown in FIG. 6, the load bracket assembly 14 can include a reinforcement flange 26 extending within the first and second chord extension flanges 22*a* and 22*b*. The reinforcement flange 26 can be positioned to be received between adjacent chord angles of the bottom or top chord 4 or 6 when the load bracket assembly is secured to the top or bottom chord 4 or 6. When the set screws are tightened against the chord angles of the top of bottom chord 4 or 6, the reinforcement flange can provide a backing to help prevent bending or deformation of the chord angles as the load bracket assembly 14 is being secured to the top or bottom chord 4 or 6. As such, the load bracket assembly 14 can be configured such that chord angles of the top or bottom chord 4 or 6 can be received between the chord extension flanges 22*a* and 22*b* and the reinforcement flange of load bracket assembly 14. In some embodiments, the reinforcement flange can be a U-shaped or C-shaped flange. In other embodiments, the reinforcement flange can be a single thicker flange sized to substantially fill the space between adjacent chord angles in the top or bottom chord 4 or 6.

In some embodiments, the load bracket assembly 14 can include at least one load attachment point 32 defined on the load bracket assembly 14 for loads suspended from the bottom chord 6 of the joist 2, as shown in FIG. 7. In some embodiments, a load 19 can be connected to or suspended from the load attachment point 32 on the load bracket assembly 14, as opposed to being connected to the bottom chord 6 directly, such that the load 19 is transferred directly to and is thus carried by the load bracket assembly 14. In some embodiments, the load attachment point can be a rod or protrusion to which a load can be tied or suspended by a rope or cable. In other embodiments, as shown in FIG. 7, the load attachment point 32 can be a load attachment hole through which a load bolt or fastener 34 can be inserted. The load fastener 34 can have a head sized to abut the load bracket assembly 14 after insertion. The load fastener 34 can be inserted or connected to the load 19 such that the load 19 can be suspended from the load bracket assembly 14 via the load fastener 34.

In some embodiments, the load attachment point 32 can be positioned centrally on the load bracket assembly 14 such that the load 19 can be carried in a balanced location on the load bracket assembly 14. In FIG. 7, the load attachment point 32 is shown defined between the chord extension flanges 22 and the coupling extension flanges 24, and can further be positioned between flange extensions of the reinforcement flange 26. The load attachment point 32 can be provided at a location between the first and second chord flange extensions.

Referring again to FIG. 6, the second end 20 of adjustable coupling assembly 16 can be pivotally connected to load bracket assembly 14 by way of a bolt 36 extending through the coupling portion 24 and the second end 20 of the adjustable coupling assembly 14. The bolt can extend through a hole in the first coupling flange extension 24*a*, through an eyelet in the second end 20 of the adjustable coupling assembly 16, and through a hole in the second coupling flange extension 24*b*. A nut can be threaded onto the bolt 36 to secure the pivotal connection between the second end 20 of the adjustable coupling assembly 16 and the coupling portion 24. The width of the second end 20 can be slightly smaller than the gap formed between the first and second coupling extension flanges 24*a* and 24*b* such that the second end 20 of the adjustable coupling assembly 16 can rotate on the bolt 36. In other embodiments, the coupling portion 24 can be a single flange that can be received between opposing flanges on the second end 20 of the adjustable coupling assembly and connected together by a similar bolt 36 and nut arrangement.

Figure 8:
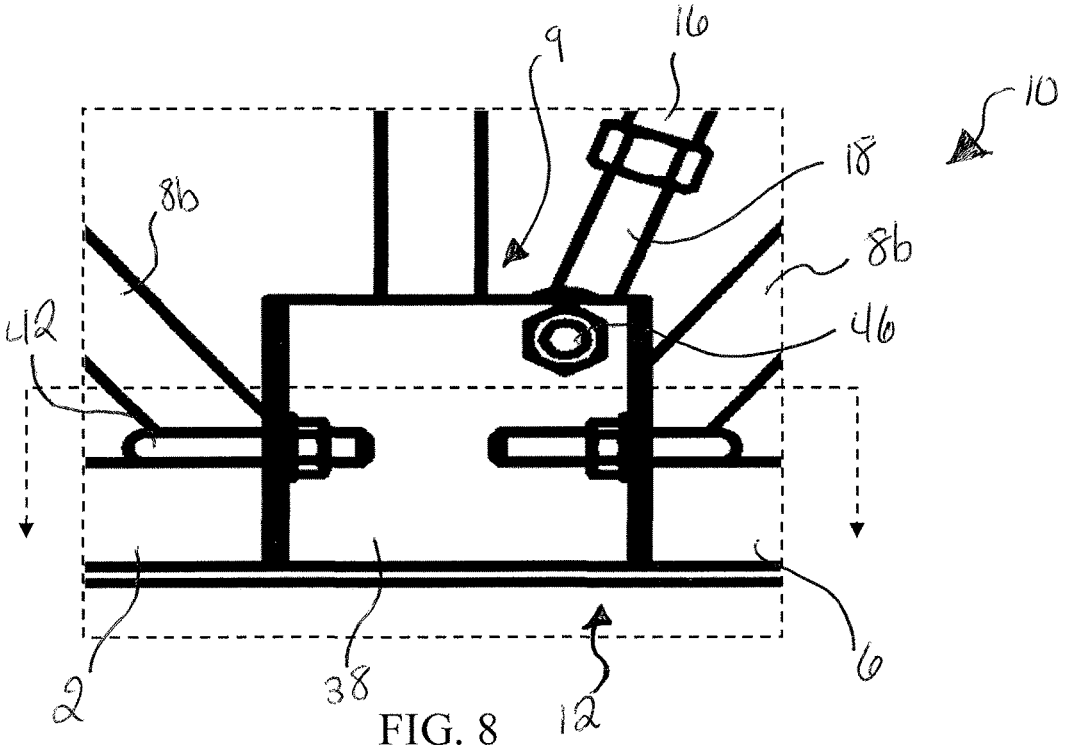
FIG. 8 is a detailed front elevation view of the panel point bracket assembly of the single point load joist reinforcement apparatus of FIG. 2.
Figure 9:
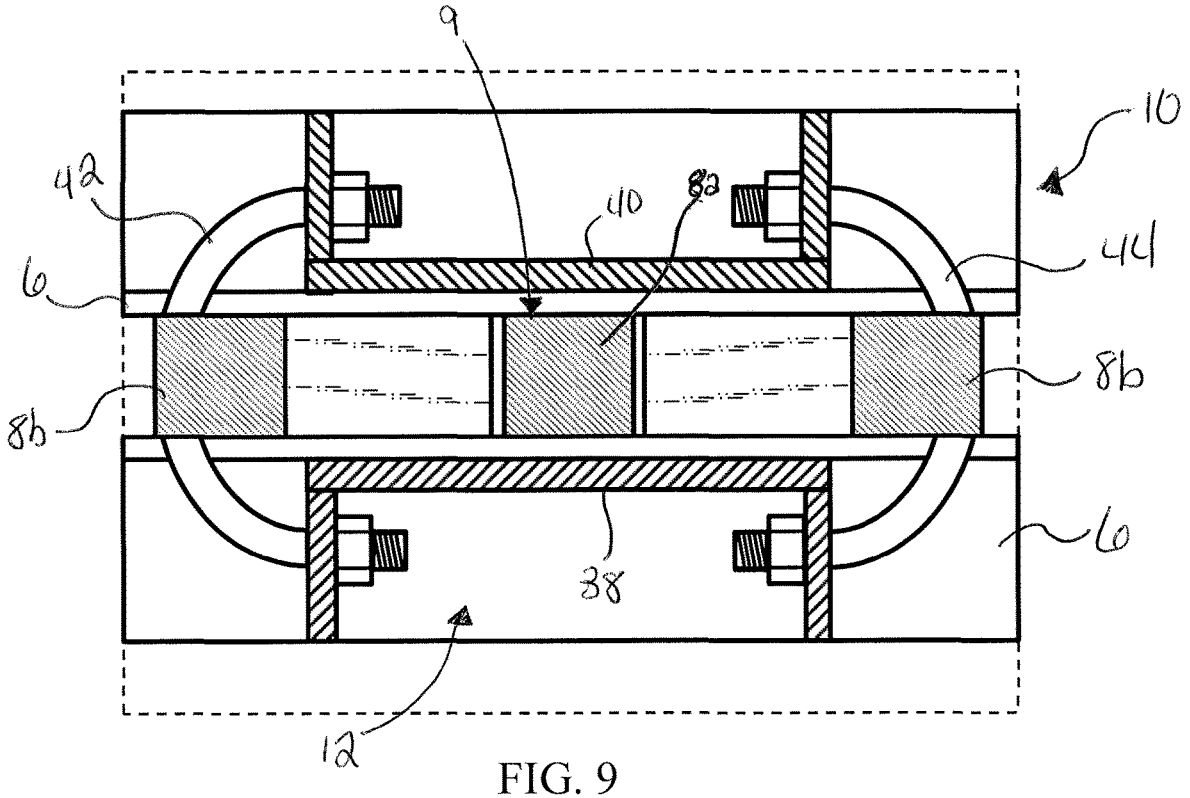
FIG. 9 is a detailed cross section view of the panel point bracket assembly of the single point load joist reinforcement apparatus of FIG. 2.

Referring now to FIGS. 8-9, the panel point bracket assembly 12 can include a first side panel point bracket 38, a second side panel point bracket 40, and at least one panel point bracket bolt 42. The first and second side panel point brackets 38 and 40 are positionable on either side of one of the panel points 9 on the joist 2, and the at least one panel point bracket bolt 42 is positionable around one of the cross supports 8 forming the panel point 9 and connectable to the first and second side panel point brackets 38 and 40 to secure the panel point bracket assembly 12 about the panel point 9. In some embodiments, the panel point bracket bolt 42 can be received under an angled cross support member 8*b* and wedge between the angled cross support member 8*b* and the adjacent chord 4 or 6, such that as the panel point bracket bolt 42 is connected to and tightened on the first and second side panel point brackets 38 and 40, the panel point bracket bolt 42 can be secured against the angled cross support member 8*b*.

In some embodiments, the panel point bracket bolt 42 can be a U-shaped or C-shaped bolt which can be shaped to extend between opposing side panel point brackets and around an angled cross support member 8*b* of the panel point 9. The panel point bracket bolt 42 can have opposing threaded ends that can be received through corresponding holes in the first and second side panel point brackets 38 and 40. Threaded nuts can be received on the opposing threaded ends of the panel point bracket bolt 42 to tighten the panel point bracket bolt 42 against the cross support member 8 of the panel point 9.

In some embodiments, a second panel point bracket bolt 44 can be connected to an opposing side of the first and second side panel point brackets 38 and 40 in a similar fashion as described above. As the first and second panel point bracket bolts 42 and 44 are tightened on the side panel point brackets 38 and 40, the first panel point bracket bolt 42 can be secured against one angled cross support member 8*b* of the panel point 9, and the second panel point bracket bolt 44 can be secured against the opposing angled cross support member 8*b* in order to clamp first and second side panel point brackets 38 and 40 to the panel point 9.

The first end 18 of the adjustable coupling assembly 16 can be pivotally connected to the panel point bracket assembly 12. In some embodiments, the first end 18 is positioned between and pivotally connected to the first and second panel point brackets 38 and 40. A panel point connection bolt 46 can be extended through a hole in the first side panel point bracket 38, through an eyelet on the first end 18 of the adjustable coupling assembly 16, and through a hole in the second side panel point bracket 40. A nut can be threaded onto the bolt 46 to secure the pivotal connection between the panel point bracket assembly 14 and the first end 18 of the adjustable coupling assembly 16. The first end 18 of the adjustable coupling assembly 16 can be sized to have clearance between the first and second side panel point brackets 38 and 40 such that the first end 18 can pivot or rotate about bolt 46.

In some embodiments, first and second side panel point brackets 38 and 40 can be integrally formed together on a flange or bracket including a connection piece spanning between the first and second side panel point brackets 38 and 40. The integrally formed flange or bracket can be inserted around the panel point 9 with first and second side panel point brackets 38 and 40 extending on either side of the panel point 9 and the connection piece extending around one of the angled cross support members 8*b* of the panel point 9. A single panel point bracket bolt 42 can then be connected to and tightened on an opposing side of the first and second side panel point brackets 38 and 40 from the connection piece to secure the panel point bracket assembly 12 on the panel point 9. In some embodiments, the connection piece can be an angled sidewall that can have an angular orientation corresponding to an angle of one of the angled cross support members 8*b*, such that a greater surface contact area between the connection piece and the angled cross support member 8*b* can be provided when the flange or bracket is installed around the panel point 9.

Figure 5:
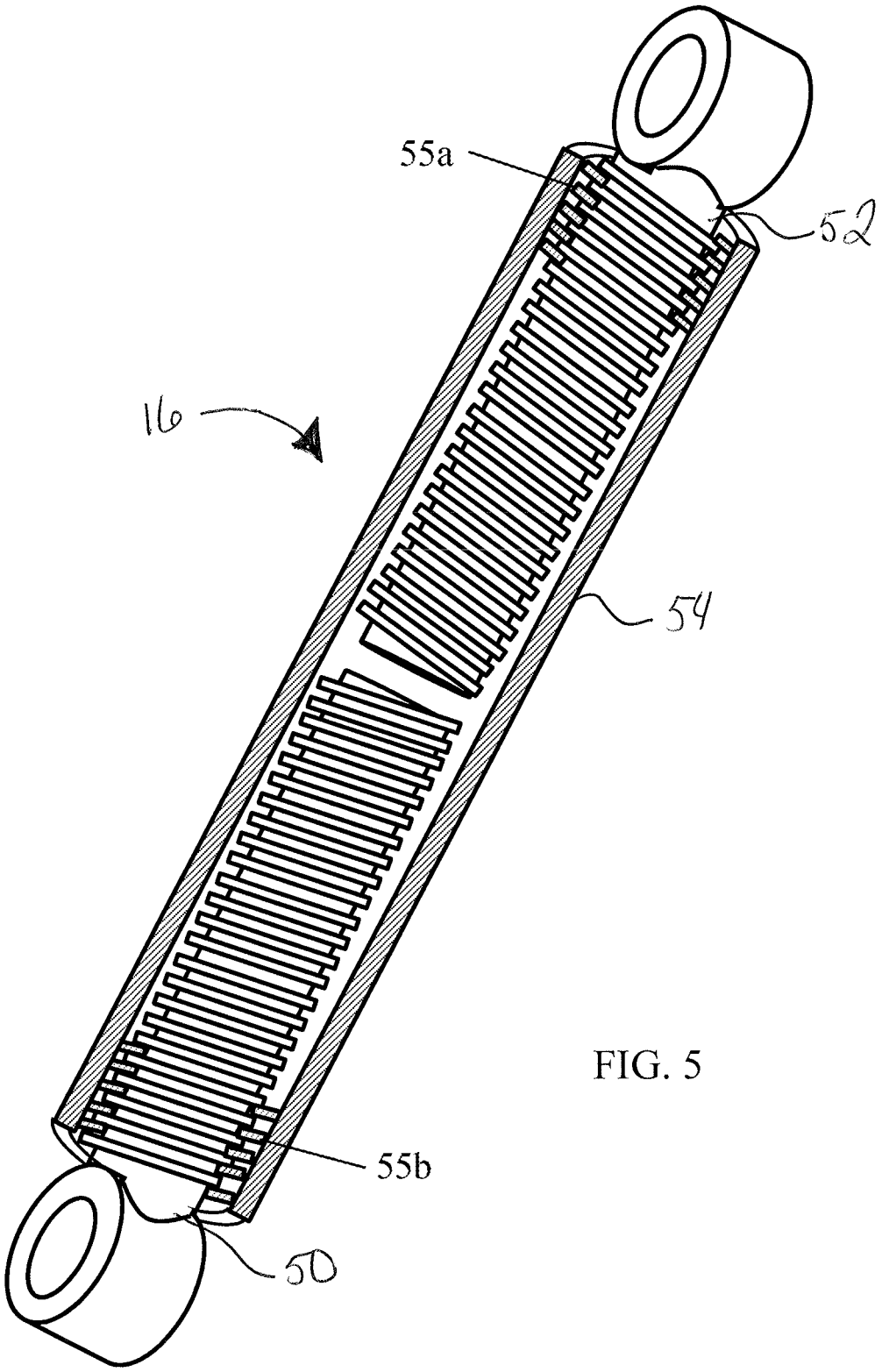
FIG. 5 is a cross section view of an adjustable coupling assembly of the single point load joist reinforcement apparatus of FIG. 2.

Referring now to FIGS. 4-5, the adjustable coupling assembly 16 can include a first extension rod 50 pivotally connected to the pivot point bracket assembly 12, and a second extension rod 52 can be pivotally connected to the load bracket assembly 14. The first extension rod 50 can form the first end 18 of the adjustable coupling assembly 16 and the second extension rod 52 can form the second end 20 of the adjustable connection assembly 16. The first and second rods 50 and 52 can be adjustably received in opposing ends of a turnbuckle receiver 54, the adjustable coupling assembly 16 operable to adjust the extension of the first and second rods 50 and 52 from the turnbuckle receiver 54. The first and second extension rods 50 and 52 can be independently adjustable in the turnbuckle receiver 54 in some embodiments. First and second extension rods 50 and 52 can be threadingly received in the turnbuckle receiver 54. As such, the first and second extension rods 50 and 52 can be rotated relative to the turnbuckle receiver 54 to adjust the extension of the first and second extension rods 50 and 52 from the turnbuckle receiver 54.

In some embodiments, the threads 55*a* and 55*b* within the turnbuckle associated with the first and second extension rods 50 and 52 respectively can have reverse directions or orientations such that if the turnbuckle receiver 54 is rotated relative to the first and second extension rods 50 and 52 the first and second extension rods 50 and 52 can be configured to either both extend outward from or retract into the turnbuckle receiver 54. As such, once the panel point bracket assembly 12 is secured to the panel point and the load bracket assembly 14 is connected to one of the top or bottom chords 4 or 6 to prevent first and second extension rods 50 and 52 from rotating about an axis of the extension rods 50 and 52 relative to the panel point bracket assembly 12 and the load bracket assembly 14 respectively, the turnbuckle receiver 54 can be rotated to either extend or retract the extension rods 50 and 52 simultaneously and potentially place the adjustable coupling assembly 16 in either a slight tension or slight compression state depending on the particular load being applied to the joist. For instance, in a suspended load, where the adjustable coupling assembly 16 would be placed in tension, it may be desirable to adjust the coupling assembly 16 via the turnbuckle receiver 54 to a slightly tensioned state to decrease any deformation when the load is suspended from the joist. Similarly, when a load is placed on a joist such that a compressive force would be applied to the adjustable coupling assembly, it may be desirable to place the adjustable coupling assembly 16 in a slightly compressed state such that when the load is applied to the joist deformation of the chords can be decreased.

Any suitable adjustment mechanism can be employed for the adjustable coupling assembly 16 that can allow for adjustment of the length of the coupling assembly 16. For instance in some embodiments, the adjustable coupling assembly 16 can include a single extension rod that can be received into a turnbuckle receiver 54 which can be pivotally connected directly to either the panel point bracket assembly 12 or the load bracket assembly 14. In other embodiments, as opposed to a threaded engagement, the extension rod can be a telescoping rod that can be coupled to the rod receiver by an adjustable pin such that the extension rod can extend from the rod receiver at discrete distances.

When the panel point bracket assembly 12 is secured about one of the panel points 9 of the joist 2, the load bracket assembly 14 is secured to either the top chord 4 or the bottom chord 6, and the load bracket assembly 14 is subjected to a load 19, the load 19 is transferred to the panel point 9 via the loading bracket assembly 14, the adjustable coupling assembly 16, and the panel point bracket assembly 12.

Having an adjustable coupling assembly 16 that is pivotally connected to the panel point bracket assembly 12 and the load bracket assembly 14 can allow the single point joist reinforcement apparatus 10 to support load that are vertically offset from the panel point as the reinforcement apparatus can be oriented angularly between the panel point bracket assembly 12 and the load bracket assembly 12 while the load can still be transferred back to the panel point 9 for structural support.

Another aspect of the present disclosure is a method of reinforcing a joist to support a supplemental load at a predetermined location on the joist, the joist having a top chord, a bottom chord, and a plurality of cross supports extending between the top chord and the bottom chord, the plurality of cross supports forming panel points along the joist, the method including the steps of securing a panel point bracket assembly about one of the panel points on the joist; pivotally connecting a first end of an adjustable coupling assembly to the panel point bracket assembly; pivotally connecting a load bracket assembly to a second end of the adjustable coupling assembly; and clamping the load bracket assembly to either the top chord or the bottom chord of the joist adjacent the predetermined location for the supplemental load. In some embodiments, the method can further include the step of suspending the supplemental load from the load bracket assembly.

The step of clamping the load bracket assembly to either the top chord or bottom chord of the joist can further include adjusting the adjustable coupling assembly to secure the load bracket assembly to either the top chord or the bottom chord of the joist at the desired location. In some embodiments, the desired location of the supplemental load can be vertically offset from the panel point.

In some embodiments, the panel point bracket further comprises a first panel point bracket, a second panel point bracket, and a bolt, and clamping the panel point bracket to the panel point can further include positioning the first and second panel point brackets on opposing sides of the panel point, and connecting the bolt between the first and second panel point brackets to secure the first and second panel point brackets about the panel point.

Figure 10:
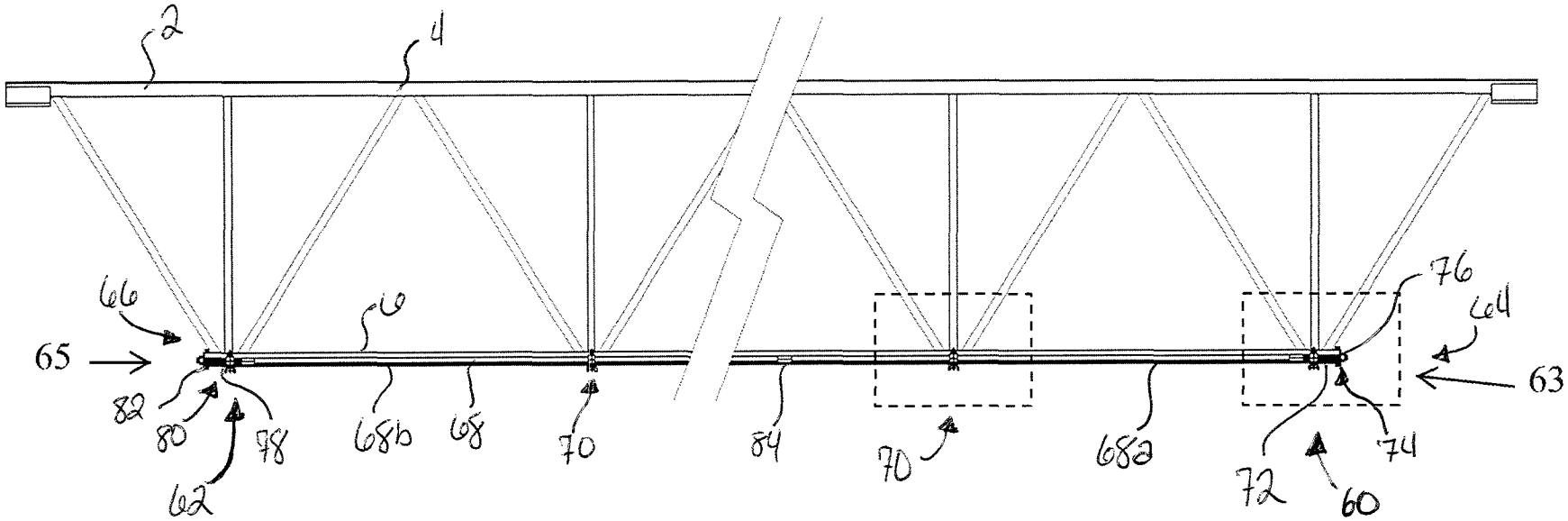
FIG. 10 is a front elevation view of a joist chord reinforcement apparatus of the present disclosure.
Figure 11:
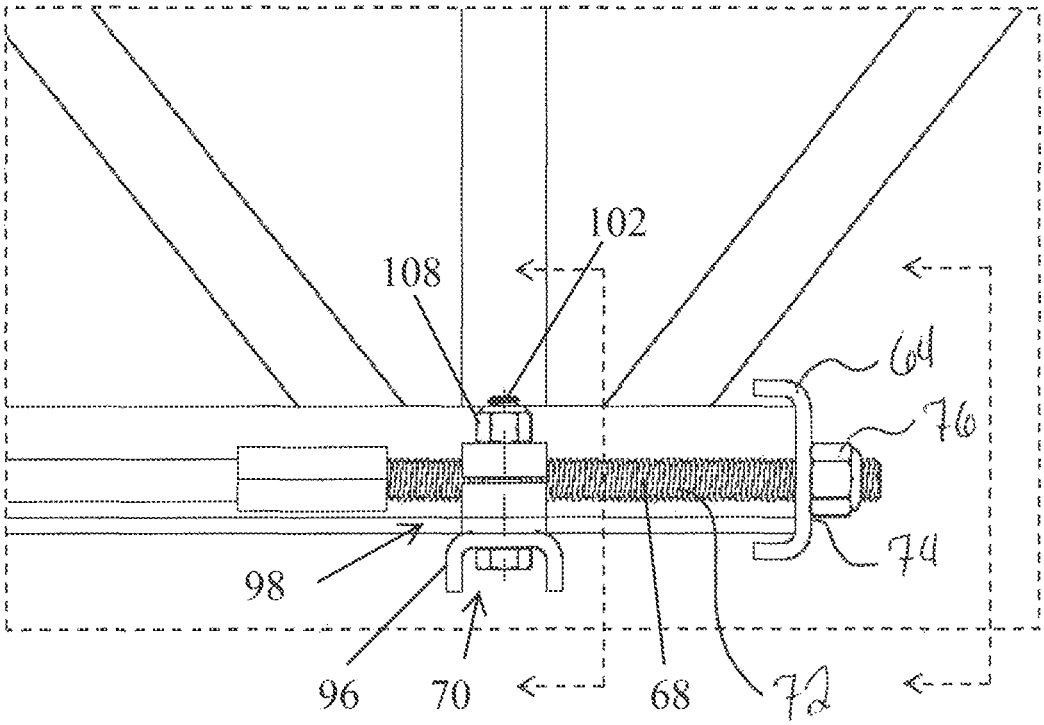
FIG. 11 is a detailed front elevation view of a first chord end bracket and clamping assembly of the joist chord reinforcement apparatus of FIG. 10.
Figure 12:
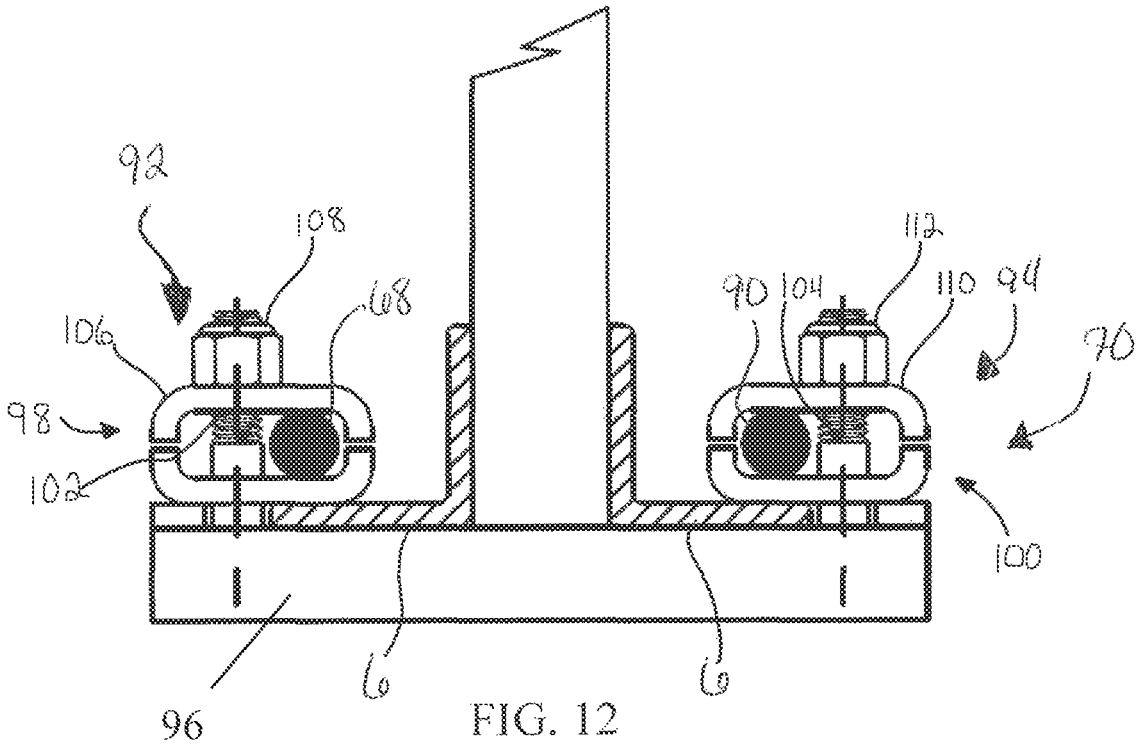
FIG. 12 is a detailed cross section view of a rod clamping assembly of the joist chord reinforcement apparatus of FIG. 11.

Another aspect of the present disclosure is a joist chord reinforcement apparatus 10 for reinforcing an entire chord shown in FIG. 10. Such reinforcement may be necessary if the addition of a new load on a joist will exceed the maximum load allowable for the joist. Then the chord must be reinforced along substantially its entire length. The joist reinforcement apparatus 10 in such situations can be used to reinforce a joist 2 having a chord 6 with a first chord end 60 and a second chord end 62. The apparatus 10 can include a first chord end clamping assembly 63 and a second chord end clamping assembly 65 operable to clamp reinforcement rod 68 to first and second ends 60 and 62 of chord 4,6 respectively. The first chord end clamping assembly 63 can include a first chord end bracket 64 and the second chord end clamping assembly 65 can include a second chord end bracket 66. A first reinforcement rod 68 can be securable between the first and second chord end brackets 64 and 66 to clamp the first and second chord end brackets 64 and 66 against corresponding first and second chord ends 60 and 62 of the joist 2. At least one rod clamping assembly 70 can be operable to clamp the first reinforcement rod 68 to the chord 6 at a location between the first and second chord end brackets 64 and 66 when the first reinforcement rod 68 is secured between the first and second chord end brackets 64 and 66 and the first and second chord end brackets 64 and 66 are clamped against corresponding first and second chord ends 60 and 62 of the joist 2. In some embodiments, the at least one rod clamping assembly 70 can be clamped at a position along chord 6 adjacent a panel point 9 of the joist 2. In other embodiments, the apparatus 10 can include a plurality of rod clamping assemblies, each rod clamping assembly 70 operable to clamp the first reinforcement rod 68 to the chord 6 at a corresponding location along the chord 6 adjacent a corresponding panel point 9. Having rod clamping assemblies 70 positioned adjacent panel points 9 of the chord 6 can provide additional support to the joist 2 as the load can be transferred via the first reinforcement rod 68 and the rod clamping assemblies 70 to various panel points 9 along the chord 6.

In some embodiments, the first reinforcement rod 68 can include a first threaded end 72. The first chord end bracket 64 includes a first end hole 74, the first threaded end 72 of the first reinforcement rod 68 extendable though the first end hole 74. The first reinforcement rod 68 can further include a second threaded end 78. the second chord end bracket 66 can include a second end hole 80, the second threaded end 78 of the first reinforcement rod 68 extendable through the second end hole 80. A first clamping nut 76 can be tightenable on the first threaded end 74 of the first reinforcement rod 68 and a second clamping nut 82 can be tightenable on the second threaded end 78 to secure the first reinforcement rod 68 between the first and second chord end brackets 64 and 66 to clamp the first and second chord end brackets 64 and 66 against corresponding first and second chord ends 60 and 62 of the joist 2. The first reinforcement rod 68 can thus be clamped adjacent the chord 6.

In some embodiments, the first reinforcement rod 68 can include a plurality of rod segments 68*a* and 68*b* removably connected together, wherein a first rod segment 68*a* of the first reinforcement rod 68 is securable to the first chord end bracket 64 and a second rod segment 68*b* of the first reinforcement rod 68 is securable to the second chord end bracket 66. First and second rod segments 68*a* and 68*b* can then be connected together via a coupling nut 84. The coupling nut 84 can be configured to receive ends of adjacent rod segments 68*a* and 68*b* to removably connect the adjacent rod segments 68*a* and 68*b* together. In other embodiments, rod 68 can include one or more additional rod segments positioned between first and second rod segments 68*a* and 68*b*, each adjacent pair of rod segments connected together via a coupling nut 84. Having a rod made up of multiple rod segments can allow for easier shipping as the rod can be broken down into smaller segments. Additionally, segments of varying lengths can be connected together to accommodate chords having varying lengths, as opposed to having to tailor a given reinforcement rod 68 to a particular chord length in a single piece.

Figure 13:
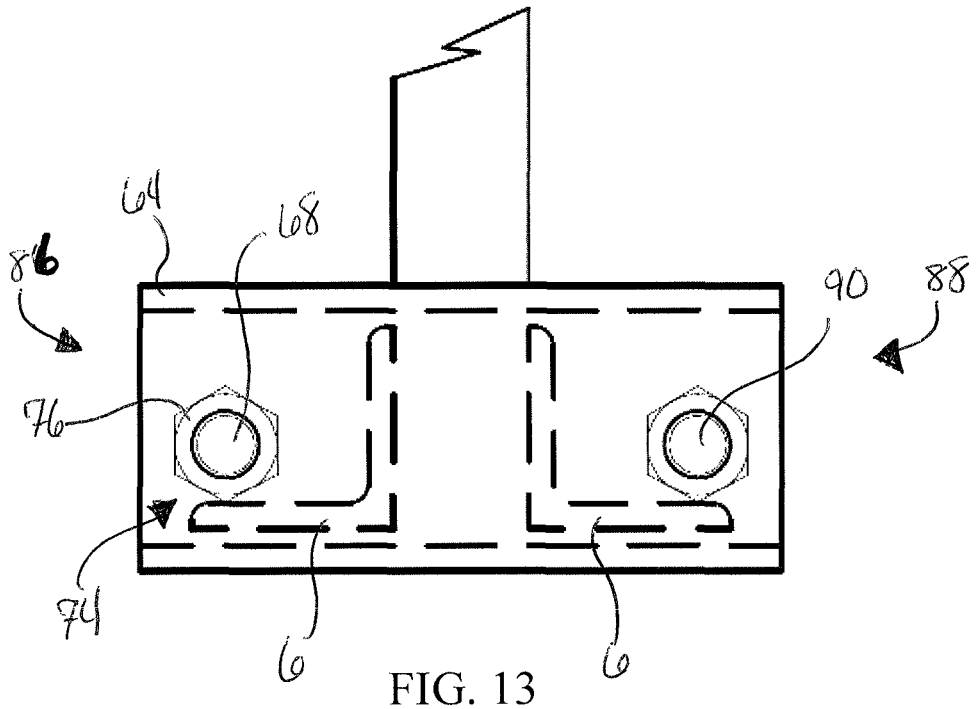
FIG. 13 is a left side elevation view of a first end bracket of the joist chord reinforcement apparatus of FIG. 11.
Figure 14:
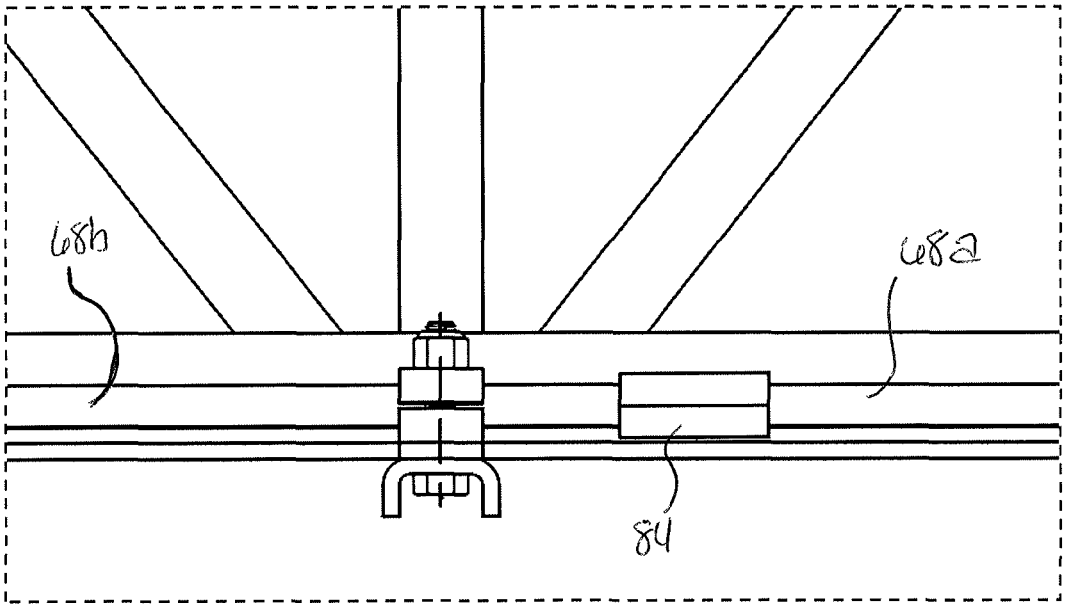
FIG. 14 is a front elevation view of a coupling nut of the joist chord reinforcement apparatus of FIG. 10 configured to receive ends of adjacent rod segments to removably connect the adjacent rod segments together.
Figure 15:
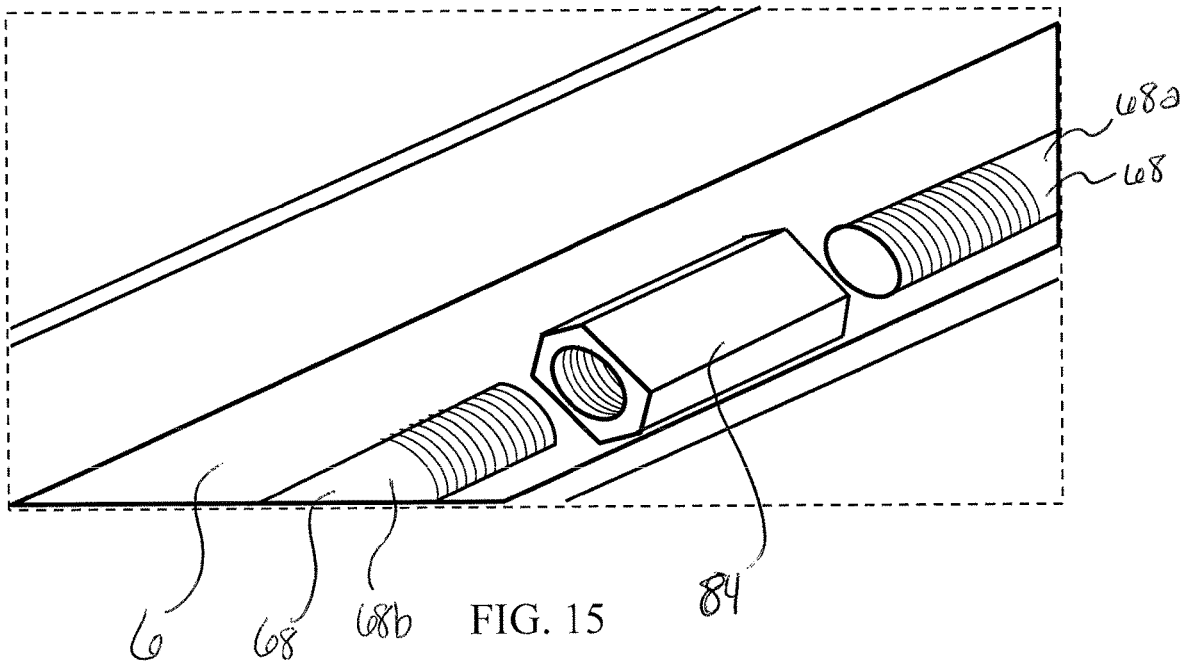
FIG. 15 is a perspective exploded view of two rod segments of FIG. 14 being coupled to a coupling nut.

In some embodiments, the chord 6 of the joist 2 further includes a first chord side 86 and a second chord side 88, and the apparatus 10 can further include a second reinforcement rod 90 securable between the first and second chord end brackets 64 and 66. The first reinforcement rod 68 can be positionable on the first chord side 86 of the chord 6 and the second reinforcement rod 90 is positionable on the second chord side 88 of the chord 6 when the first and second chord end brackets 64 and 66 are positioned adjacent corresponding first and second chord ends 60 and 62 of the joist 2 and the first and second reinforcement rods 68 and 90 are secured between the first and second chord end brackets 64 and 66 to clamp the first and second chord end brackets 64 and 66 against corresponding first and second chord ends 60 and 62 of the joist 2. As can be seen from FIG. 13, the chord end bracket 64 can receive the first ends of both the first and second reinforcement rods 68 and 90, as can the second chord end bracket. In joists having a double chord angle configuration for the top chord 4 or bottom chord 6, the first reinforcement rod 68 can be positioned on or adjacent a first chord angle, and the second reinforcement rod 90 can be positioned on or adjacent the second chord angle.

Referring now to FIGS. 11-14, at least one rod clamping assembly 70 can secure the first reinforcement rod 68 and the second reinforcement rod 90 to the chord 6. The rod clamping assembly 70 can include a first clamping element 92 and a second clamping element 94, the first clamping element 92 operable to removably clamp the first reinforcement rod 68 to the first side 86 of the chord 6 and the second clamping element 94 operable to removably clamp the second reinforcement rod 90 to the second side 88 of the chord 6 at a location between the first and second chord end brackets 64 and 66. The rod clamping assembly 70 can further include a clamping bracket 96 having a first clamping bracket end 98 and a second clamping bracket end 100, the first clamping element 92 positioned on the first clamping bracket end 98 and the second clamping element 94 can be positioned on the second clamping bracket end 100. The clamping bracket 96 can be oriented transversely to the chord 4 or 6 so that the first clamping element 92 is positioned to clamp the first reinforcement rod 68 to the first side 86 of the chord 4 or 6 and the second clamping element 94 is positioned to clamp the second reinforcement rod 90 to the second side 88 of the chord 4 or 6.

Referring again to FIGS. 11-14, the first clamping bracket end 98 can include a first threaded extension 102 and the second clamping bracket end 100 can include a second threaded extension 104. The first threaded extension 102 is positionable adjacent the first side 86 of the chord 4 or 6 and the second threaded extension 104 is positionable adjacent the second side 88 of the chord 4 or 6 when the clamping bracket 96 is oriented transverse to the chord 4 or 6. The first clamping element 92 can include a first set of opposing clamping jaws 106 disposed on the first threaded extension 102 and a first locking nut 108 can be screwable onto the first threaded extension 102 to clamp the first set of clamping jaws 106 around the first reinforcement rod 68. Similarly, the second clamping element 94 can include a second set of opposing clamping jaws 110 disposed on the second threaded extension 104 and a second locking nut 112 screwable onto the second threaded extension 104 to clamp the second set of clamping jaws 110 around the second reinforcement rod 90. Each of the clamping jaws in the first and second sets of clamping jaws 106 and 110 can have either a C-shape or U-shape, the clamping jaws in each set of clamping jaws 106 and 110 oriented in opposing directions. In embodiments with multiple clamping assemblies 70, each of the clamping assemblies 70 can have the double clamping element configuration described above.

In some embodiments, the first chord end bracket 64 and the second chord end bracket 66 each have either a C-shape or a U-shape, the first chord end 60 receivable in the first chord end bracket 64 and the second chord end 62 receivable in the second chord end bracket 66.

Another aspect of the present disclosure is a method of reinforcing a metal joist including a chord, the chord having a first chord end and a second chord end, the method including the steps of providing a first reinforcement rod having a first rod end and a second rod end; securing the first rod end to the first end of the chord; securing the second rod end to the second end of the chord; and clamping the first reinforcement rod to the chord in at least one location between the first and second chord ends. In some embodiments, the method can further include clamping the first reinforcement rod to the chord at multiple locations between the first and second chord ends.

In some embodiments wherein the joist includes a top chord, a bottom chord, and a plurality of cross support members extending between the top and bottom chords, the plurality of cross members forming at least one panel point along the joist where two or more of the cross support members converge, the clamping step of the method can further includes clamping the first reinforcement rod to the chord in at least one location between the first and second chord end brackets that is aligned with the at least one panel point of the joist.

In some embodiments, the securing steps can further include positioning a first chord end bracket against the first chord end; positioning a second chord end bracket against the second chord end; and securing the first rod end of the first reinforcement rod to the first chord end bracket and the second rod end of the first reinforcement rod to the second chord end bracket to secure the first rod end to the first chord end and the second rod end to the second chord end. The method can further include the step of tensioning the first reinforcement rod between the first and second chord end brackets. In some embodiments wherein the chord has a first side and a second side, the method further includes the steps of clamping the first reinforcement rod to the first side of the chord in at least one location between the first and second chord ends; providing a second reinforcement rod having a first second rod end and a second second rod end; securing the first second rod end to the first end of the chord; securing the second second rod end to the second end of the chord; and clamping the second reinforcement rod to the second side of the chord in at least a second location between the first and second chord ends.

Figure 16:
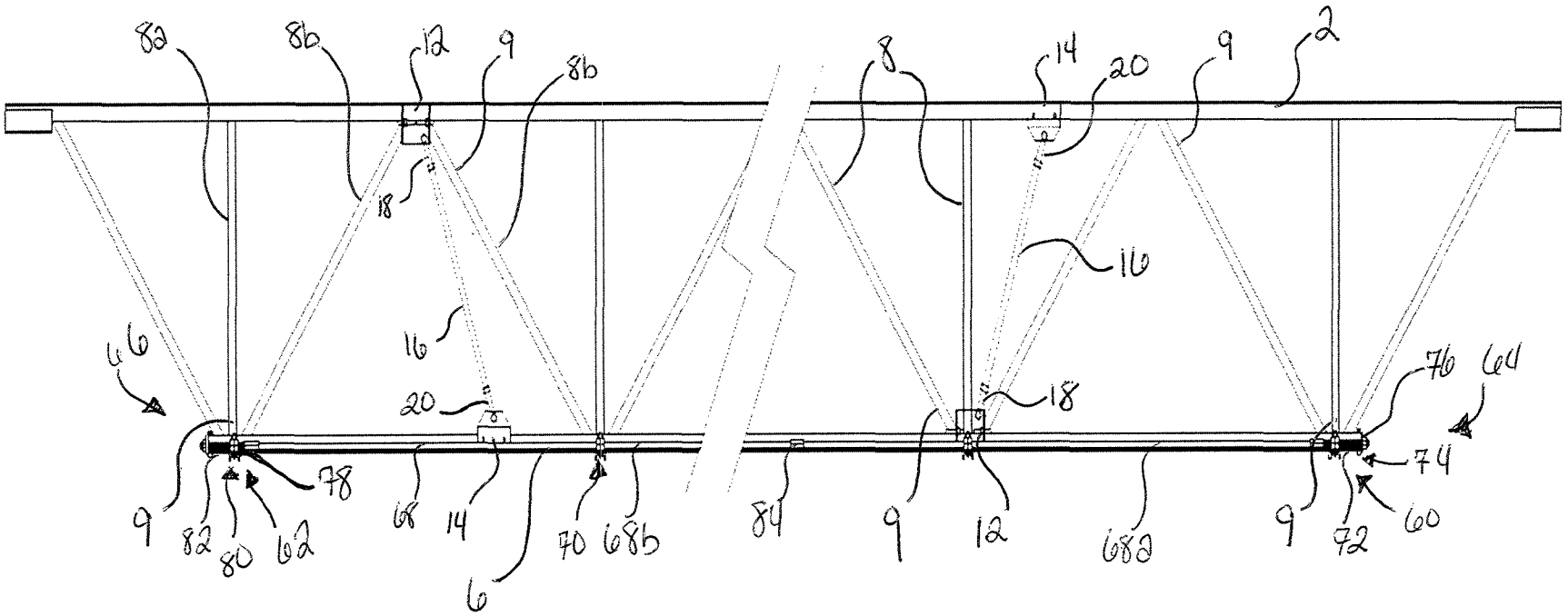
FIG. 16 is a perspective front elevation view of a joist reinforcement system including both a joist chord reinforcement apparatus as well as multiple single point load joist reinforcement apparatuses.
Figure 17:
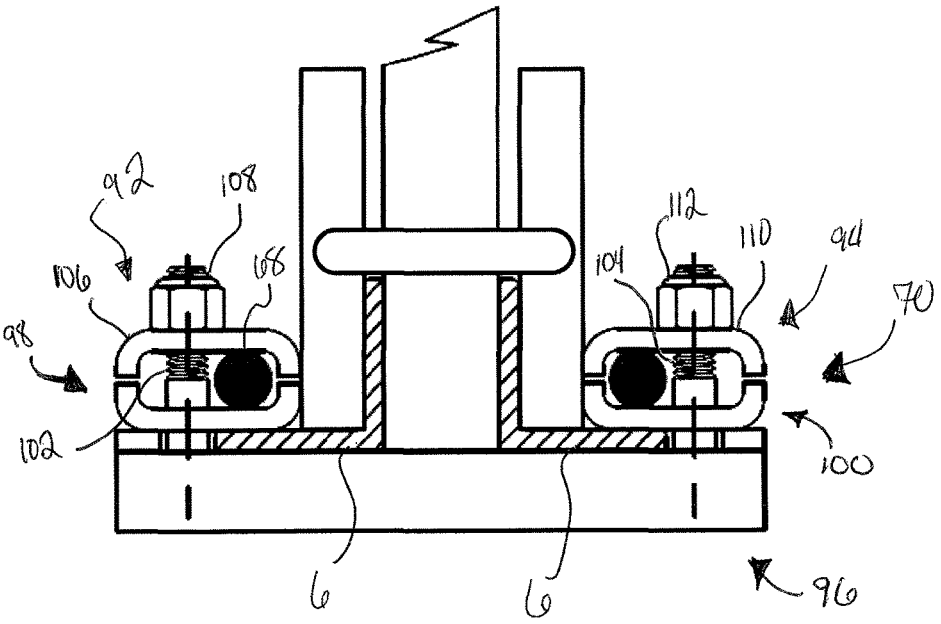
FIG. 17 is a detailed cross section view of the joist reinforcement system of FIG. 16 showing the positioning of a panel point bracket assembly in relation to a reinforcement rod and rod clamping assembly.
Figure 18:
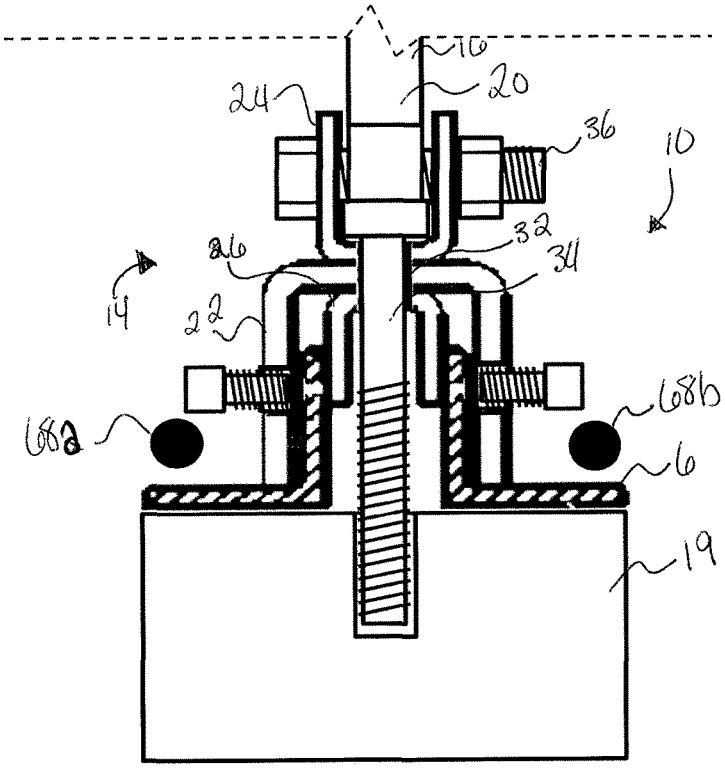
FIG. 18 is a detailed cross section view of the joist reinforcement system of FIG. 16 showing the positioning of a load bracket assembly in relation to a reinforcement rod and rod clamping assembly.

As can be seen in FIGS. 16-18, in some embodiments the joist reinforcement system 10 can include both at least one single point load reinforcement aspects and a chord reinforcement aspects on the single joist 2 to point reinforce the chord proximate a load and reinforce and strengthen the entire chord. In some embodiments, the load bracket assembly 14 and the panel point bracket assembly 12 can slide behind or be positioned above the reinforcement rods 68 and 90 to accommodate both single-point and full chord reinforcement techniques.

Thus, although there have been described particular embodiments of the present invention of a new and useful NON-WELD JOIST REINFORCEMENT SYSTEM AND METHOD, it is not intended that such references be construed as limitations upon the scope of this invention.

What is claimed is:

1. A joist chord reinforcement apparatus for a joist having a chord with a first chord end and a second chord end, the apparatus comprising:

a first chord end bracket;

a second chord end bracket;

a first reinforcement rod securable between the first and second chord end brackets to move the first and second chord end brackets toward one another to clamp the first and second chord end brackets against corresponding first and second chord ends of the joist; and at least one rod clamping assembly operable to clamp the first reinforcement rod to the chord at a location between the first and second chord end brackets when the first reinforcement rod is secured between the first and second chord end brackets and the first and second chord end brackets are clamped against corresponding first and second chord ends of the joist.

2. The apparatus of claim 1, wherein:

the first reinforcement rod includes a first threaded end;

the first chord end bracket includes a first end hole, the first threaded end of the first reinforcement rod extendable through the first end hole; and the apparatus further comprises a clamping nut tightenable on the first threaded end of the first reinforcement rod to secure the first reinforcement rod between the first and second chord end brackets to clamp the first and second chord end brackets against corresponding first and second chord ends of the joist.

3. The apparatus of claim 2, wherein:

the first reinforcement rod further includes a second threaded end;

the second chord end bracket includes a second end hole, the second threaded end of the first reinforcement rod extendable through the second end hole; and the apparatus further comprises a second clamping nut tightenable on the second threaded end to secure the first reinforcement rod between the first and second chord end brackets to clamp the first and second chord end brackets against corresponding first and second chord ends of the joist.

4. The apparatus of claim 1, wherein the first reinforcement rod includes a plurality of rod segments removably connected together, wherein a first rod segment of the first reinforcement rod is securable to the first chord end bracket and a second rod segment of the first reinforcement rod is securable to the second chord end bracket.

5. The apparatus claim 4, wherein the reinforcement rod further comprises at least one coupling nut configured to receive ends of adjacent rod segments to removably connect the adjacent rod segments together.

6. The apparatus of claim 1, comprising:

a second reinforcement rod securable between the first and second chord end brackets;

wherein the first reinforcement rod is positionable on a first chord side of the chord and the second reinforcement rod is positionable on a second chord side of the chord when the first and second chord end brackets are positioned adjacent corresponding first and second chord ends of the joist and the first and second reinforcement rods are secured between the first and second chord end brackets to clamp the first and second chord end brackets against corresponding first and second chord ends of the joist.

7. The apparatus of claim 6, wherein the at least one rod clamping assembly includes a first clamping element and a second clamping element, the first clamping element operable to removably clamp the first reinforcement rod to the first side of the chord and the second clamping element operable to removably clamp the second reinforcement rod to the second side of the chord at a location between the first and second chord end brackets.

8. The apparatus of claim 7, wherein:

the rod clamping assembly further comprises a clamping bracket having a first clamping bracket end and a second clamping bracket end, the first clamping element positioned on the first clamping bracket end and the second clamping element positioned on the second clamping bracket end; and the clamping bracket is orientable transversely to the chord so that the first clamping element is positioned to clamp the first reinforcement rod to the first side of the chord and the second clamping element is positioned to clamp the second reinforcement rod to the second side of the chord.

9. The apparatus of claim 8, wherein:

the first clamping bracket end includes a first threaded extension and the second clamping bracket end includes a second threaded extension;

the first threaded extension is positionable adjacent the first side of the chord and the second threaded extension is positionable adjacent the second side of the chord when the clamping bracket is oriented transverse to the chord;

the first clamping element includes a first set of opposing clamping jaws disposed on the first threaded extension and a first locking nut screwable onto the first threaded extension to clamp the first set of clamping jaws around the first reinforcement rod; and the second clamping element includes a second set of opposing clamping jaws disposed on the second threaded extension and a second locking nut screwable onto the second threaded extension to clamp the second set of clamping jaws around the second reinforcement rod.

10. The apparatus of claim 9, wherein each of the clamping jaws have either a C-shape or U-shape, the clamping jaws oriented in opposing directions.

11. The apparatus of claim 1, wherein the at least one rod clamping assembly further comprises opposing clamping jaws shaped to receive the first reinforcement rod between the clamping jaws, the clamping jaws operable to clamp around the first reinforcement rod.

12. The apparatus of claim 1, wherein the first chord end bracket and the second chord end bracket each has either a C-shape or a U-shape, the first chord end receivable in the first chord end bracket and the second chord end receivable in the second chord end bracket.

13. A method of reinforcing a metal joist including a top chord, a bottom chord, and a plurality of cross support members extending between the top and bottom chords, the plurality of cross members forming at least one panel point along the joist where two or more of the cross support members converge, the bottom chord and the top chord each having a first chord end and a second chord end, the method comprising the steps of:

providing a first reinforcement rod having a first rod end and a second rod end; and on either the bottom chord or the top chord:

securing the first rod end to the first end of the chord;

securing the second rod end to the second end of the chord; and clamping the first reinforcement rod to the chord in at least one location between the first and second chord ends that is aligned with the at least one panel point of the joist.

14. The method of claim 13, wherein the securing steps further comprise:

positioning a first chord end bracket against the first chord end;

positioning a second chord end bracket against the second chord end; and securing the first rod end of the first reinforcement rod to the first chord end bracket and the second rod end of the first reinforcement rod to the second chord end bracket to secure the first rod end to the first chord end and the second rod end to the second chord end.

15. The method of claim 14, further comprising the step of tensioning the first reinforcement rod between the first and second chord end brackets.

16. The method of claim 13, wherein the chord has a first side and a second side, the method further comprising the steps of:

clamping the first reinforcement rod to the first side of the chord in at least one location between the first and second chord ends;

providing a second reinforcement rod having a second rod first end and a second rod second end;

securing the second rod first end to the first end of the chord;

securing the second rod second end to the second end of the chord; and clamping the second reinforcement rod to the second side of the chord in at least a second location between the first and second chord ends.

17. The method of claim 13, further comprising the step of clamping the first reinforcement rod to the chord at multiple locations between the first and second chord ends.

18. A joist chord reinforcement apparatus for a metal joist having a chord with a first chord end and a second chord end, the apparatus comprising:

a reinforcement rod having a first rod end and a second rod end;

a first end clamp assembly operable to clamp the first end of the reinforcement rod to the first chord end of the metal joist;

a second end clamp assembly operable to clamp the second end of the reinforcement rod to the second chord end of the metal joist;

a plurality of rod clamping assemblies operable to clamp the reinforcement rod to the chord at spaced locations between the first and second end clamp assemblies when the first end clamp assembly is clamping the first end of the reinforcement rod to the first chord end of the metal joist and the second end clamp assembly is clamping the first end of the reinforcement rod to the first chord end of the metal joist;

wherein the reinforcement rod is securable between the first and second end clamp assemblies to move the first and second end clamp assemblies toward one another to clamp the first and second end clamp assemblies against corresponding first and second chord ends of the joist.

* * * * *